US005528100A

United States Patent [19]

Igeta et al.

[11] Patent Number: 5,528,100

[45] Date of Patent: Jun. 18, 1996

[54] FLAT CATHODE-RAY TUBE

[75] Inventors: Shunichi Igeta; Koji Nakamura, both of Nagaokakyo; Makoto Ishizuka, Osaka; Tsunehiko Sugawara, Funabashi; Otojiro Kida, Yokohama, all of Japan

[73] Assignee: Mitsubishi Denki Kabushiki Kaisha, Tokyo, Japan

[21] Appl. No.: 267,754

[22] Filed: Jul. 5, 1994

[30] Foreign Application Priority Data

Oct. 4, 1993 [JP] Japan ..... 5-248128

[51] Int. Cl.[6] ..... H01J 31/00

[52] U.S. Cl. ..... 313/477 R; 313/479

[58] Field of Search ..... 313/477 R, 479; 228/903; 428/446

[56] References Cited

U.S. PATENT DOCUMENTS

| | | | |
|---|---|---|---|
| 4,019,080 | 4/1977 | Besson | 313/317 |
| 4,310,598 | 1/1982 | Takami et al. | 428/406 |
| 4,352,889 | 10/1982 | Takami et al. | 501/15 |
| 4,374,942 | 2/1983 | Takami et al. | 523/210 |
| 4,398,980 | 8/1983 | Kelsey, Jr. et al. | 156/89 |
| 4,430,360 | 2/1984 | Bill et al. | 427/453 |
| 4,544,091 | 10/1985 | Hidler et al. | 228/124.1 |
| 4,608,516 | 8/1986 | Oki | 313/477 R |
| 4,713,520 | 12/1987 | Van Nice et al. | 219/121.63 |
| 4,792,722 | 12/1988 | Francis | 313/477 R |
| 4,885,640 | 8/1989 | Caple | 313/477 R |
| 5,200,241 | 4/1993 | Nied et al. | 428/34.6 |
| 5,248,914 | 9/1993 | Capek et al. | 313/402 |
| 5,293,096 | 3/1994 | Nakamura | 313/477 R |
| 5,304,890 | 4/1994 | Tsukui et al. | 313/477 R |

FOREIGN PATENT DOCUMENTS

| | | | |
|---|---|---|---|
| 3911343 | 4/1989 | Germany | H01J 31/12 |
| 57-77078 | 5/1982 | Japan . | |
| 59-97581 | 6/1994 | Japan . | |

*Primary Examiner*—Donald J. Yusko
*Assistant Examiner*—Lawrence D. Richardson

[57] ABSTRACT

A flat cathode-ray tube in which a ceramics film or a glass film is formed by thermal spray on the coupled surface of a metal case. This assembly and a glass screen are coupled through crystallized frit glass or by glass fusion. The coupling between the metal case and the glass screen has a coupling strength sufficient to resist the vacuum stress. The metal case, which is not exposed for a long time to high temperatures during thermal spraying, can be made of a metal for realizing a lightweight without any thermal deformation or dimensional variations, thereby attaining satisfactory mechanical properties.

8 Claims, 12 Drawing Sheets

FLAT CATHODE-RAY TUBE

BACKGROUND OF THE INVENTION

1. Field of the Invention

The present invention relates to a flat cathode-ray tube used for such devices as the picture tube and the image display unit for video equipment.

2. Description of Related Art

FIG. 1 is a schematic plan sectional view showing a configuration of a conventional flat cathode-ray tube. In FIG. 1, numeral 7 designates a flat metal housing including a front metal case 7*a* and a rear metal case 7*b*. The front side of the front metal case 7*a* is open, and has a screen glass 4 formed with a phosphor layer 5 sealed from the front side thereof through crystallized frit glass (or a low-melting-point glass, hereinafter referred to as "the frit glass") 15. The front metal case 7*a* and the screen glass 4 are sealed by glass fusion in some applications. The metal case 7 has built therein an electron beam forming unit as a kind of electron gun including a cathode 1 making up an electron beam source, electron beam extraction means 2 for extracting an electron beam from the cathode 1 and electron beam control means 3 for controlling the passage of the electron beams extracted by the electron beam extraction means 2 with a plurality of electrode plates.

The cathode 1 and the electron beam extraction means 2 are fixed in that order inside of the rear metal case 7*b*. The electron beam control means 3 has springs 12, 12 mounted at the ends thereof and is suspended thereby, which springs 12, 12 are detachably supported on stud pins 11, 11 of ceramics erected from the side inner wall of the front metal case 7*a*.

The metal case 7 includes a front metal case 7*a* with electron beam control means 3 mounted thereon and a rear metal case 7*b* fixed with a cathode 1 and electron beam extraction means 2 coupled and sealed in opposed relationship to each other. Further, an exhaust pipe 13 for exhausting the interior of the metal case 7 to an ultrahigh vacuum state ($10^{-5}$ Pa or less) is arranged on the rear metal case 7*b*.

Explanation will be made about the operation of the flat cathode-ray tube configured as described above. Upon application of a predetermined voltage to the electron beam extraction means 2 with the cathode 1 maintained at a predetermined potential, an electron beam is extracted from the cathode 1. The passage of the electron beam is controlled by applying a control signal to the electron beam control means 3. When the electron beam is thus correctly impinged on the phosphor layer 5, an image is reproduced. In recent years, as described above, the trend is toward a metal, instead of glass, case employed in order to alleviate the increased weight with the increase in size.

In this flat cathode-ray tube, in order to couple strongly the screen glass 4 and the front metal case 7*a* to each other through frit glass 15, as shown in FIG. 2, a Cr oxide film ($Cr_2O_3$) 20 of a few μm thick is required to be formed as a preliminary treatment of the metal material (front metal case 7*a*). FIG. 3 is an enlarged sectional view showing the coupling portion between the front metal case 7*a* formed with the Cr oxide film 20 and the screen glass 4 through the frit glass 15.

The oxide film such as Cr oxide film 20, is formed in various ways. Considering the film minuteness and adherence to metal, the wet-hydrogen environment high-temperature oxidation method is considered superior in general. A stainless steel material (SUS430), for example, is known to be formed with a 3-μm oxide film after the process of 1000° C.×about 6 hours. Coupling between the oxide film formed on the metal surface and the frit glass, however, is not considered to have a sufficient coupling strength against the vacuum stress, and this coupling strength is insufficient as a structure of a vacuum case.

It is obvious, on the other hand, that the heating of a metal for long time at high temperatures is a cause of thermal deformation and has an adverse effect on the mechanical properties thereof. As it is known, an early roughening of crystalline particle of some materials leads to brittleness. Also, the heating reduces the flatness of the coupling surface, thereby uniform coupling being made difficult. The problem is therefore that dimensional variations are likely to occur after coupling.

SUMMARY OF THE INVENTION

The invention has been made in order to obviate the above-mentioned problems, and the object thereof is to provide a flat cathode-ray tube by forming a ceramics film or a glass film on the metal surface by thermal spraying in advance and coupling the metal with the glass, thereby realizing a light-weight metal case with high reliability.

A flat cathode-ray tube according to the invention is characterized in that a ceramics film is formed by thermal spraying an oxide family ceramics, or $ZrO_2$—$Y_2O_3$, for instance, at the coupling between a metal case and screen glass. A multiplicity of pores generated at the time of thermal spray and existing in the ceramics film absorbs and alleviates the difference in linear expansion coefficient between the oxide family ceramics and the metal case, so that the oxide family ceramics and the metal case are coupled in high coupling strength. Also, the metal case, which is not exposed to high temperatures during the thermal spraying unlike at the time of forming the Cr oxide film in the prior art, is subjected to a lesser thermal deformation.

The feature of the flat cathode-ray tube according to the invention lies in that a ceramics film is formed by thermal spraying an oxide family ceramics at the coupling between a metal case and screen glass, and also the ceramics film is coupled with the screen glass through crystallized frit glass. The coupling strength between the ceramics film and the crystallized frit glass is higher than that between the Cr oxide film and the crystallized frit glass in the prior art. In this way, the coupling strength between the ceramics film and the crystallized frit glass is high, and as described above, that between the ceramics film and the metal case is also high, so that the metal case can be coupled more strongly with the screen glass than in the prior art.

Another feature of the flat cathode-ray tube according to the invention is that a ceramics film is formed by thermal spraying an oxide family ceramics at the coupling portion between the metal case and the screen glass, and also the ceramics film and the screen glass are welded by fusion of glass. As described above, the coupling strength between the ceramics film and the metal case is high and the ceramics film is strongly coupled with the screen glass by glass fusion, thereby so that the metal case can be coupled more strongly with the screen glass than in the prior art.

Still another feature of the flat cathode-ray tube according to the invention resides in that a glass film is formed by thermal spraying inorganic oxide family glass such as $SiO_2$—PbO family glass at the coupled portion between a metal case and a screen glass. The thermal spraying of glass having a linear expansion coefficient substantially identical to that of the screen glass permits a coupling strength as high as that obtained when a ceramics film is formed. In this case, too, the high-temperature heat treatment is not necessary and therefore only a small thermal deformation occurs.

A further feature of the flat cathode-ray tube according to the invention is that a glass film is formed by thermal spraying inorganic oxide glass at the coupling of a metal case and in addition the glass film and the screen glass are coupled by crystallized frit glass therebetween. As a result, in addition to the above-mentioned advantages, the coupling strength between the glass film and the crystallized frit glass is higher than that between the Cr oxide film and the crystallized frit glass according to the prior art. Further, since the coupling strength between the glass film and the crystallized frit glass, and also between the glass film and the metal case is so high that the metal case can be coupled with the screen glass more strongly than in the prior art.

A still further feature of the flat cathode-ray tube according to the invention lies in that a glass film is formed by thermal spraying an inorganic oxide family glass at the coupling of a metal case, and also the glass film is coupled with the screen glass by glass fusion. As described above, the coupling strength between the glass film and the metal case is so high and the glass film and the screen glass are coupled to each other so strongly by glass fusion that the metal case and the screen glass can be coupled more strongly than in the prior art.

The above and further objects and features of the invention will more fully be apparent from the following detailed description with accompanying drawings.

DESCRIPTION OF THE PREFERRED EMBODIMENTS

The invention will be described in detail below with reference to the drawings showing embodiments.

[Embodiment 1]

Figure 1:
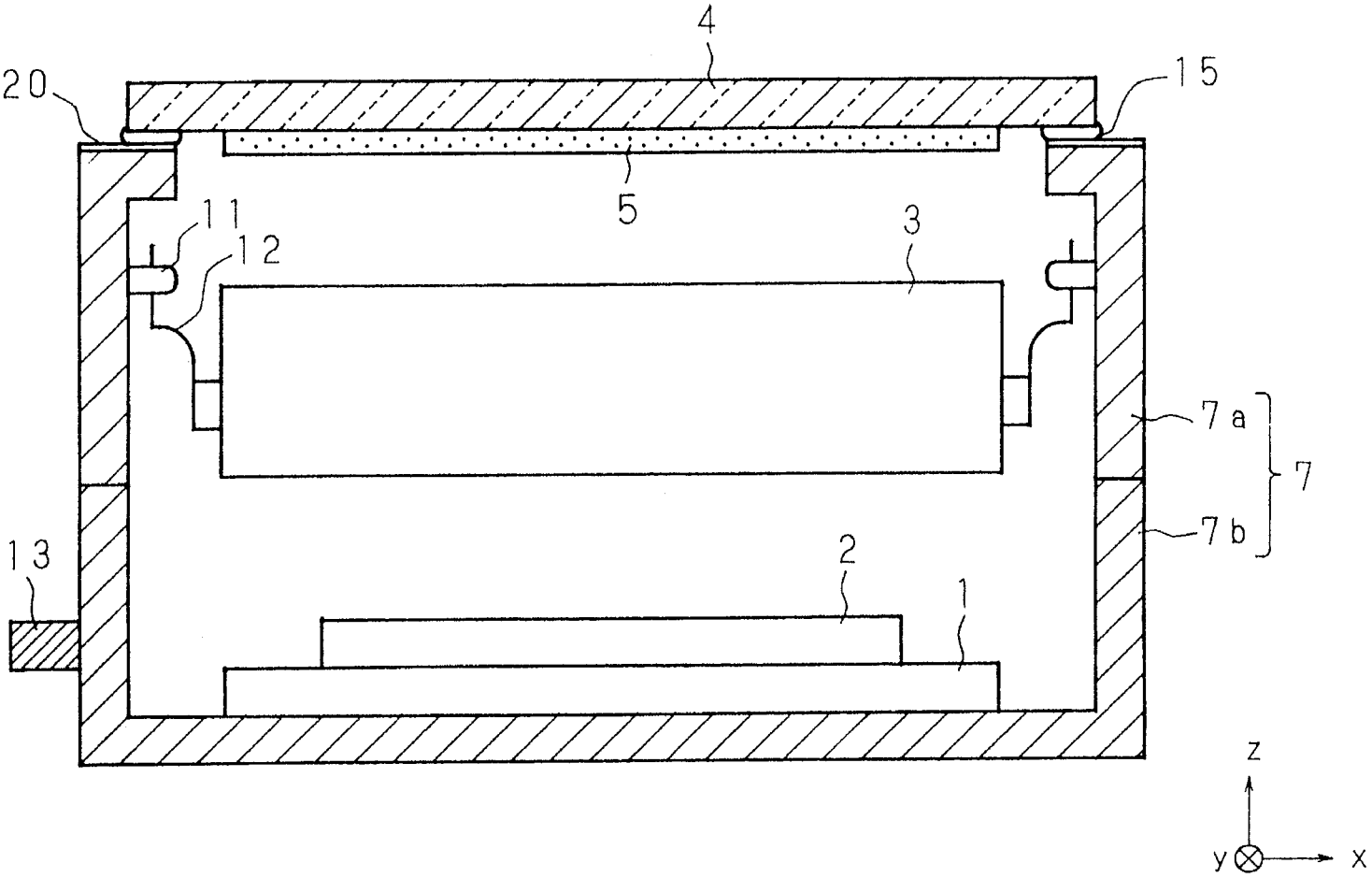
FIG. 1 PRIOR ART
FIG. 1 is a schematic plan sectional view showing a configuration of a conventional flat cathode-ray tube.
Figure 2:
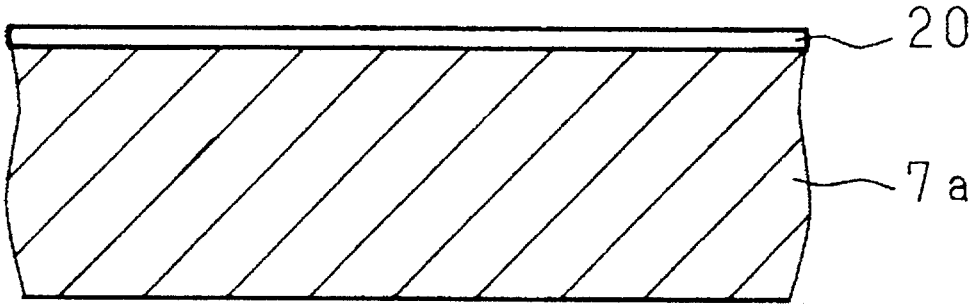
FIG. 2 PRIOR ART
FIG. 2 is a sectional view showing the front metal case subjected to pretreatment.
Figure 3:
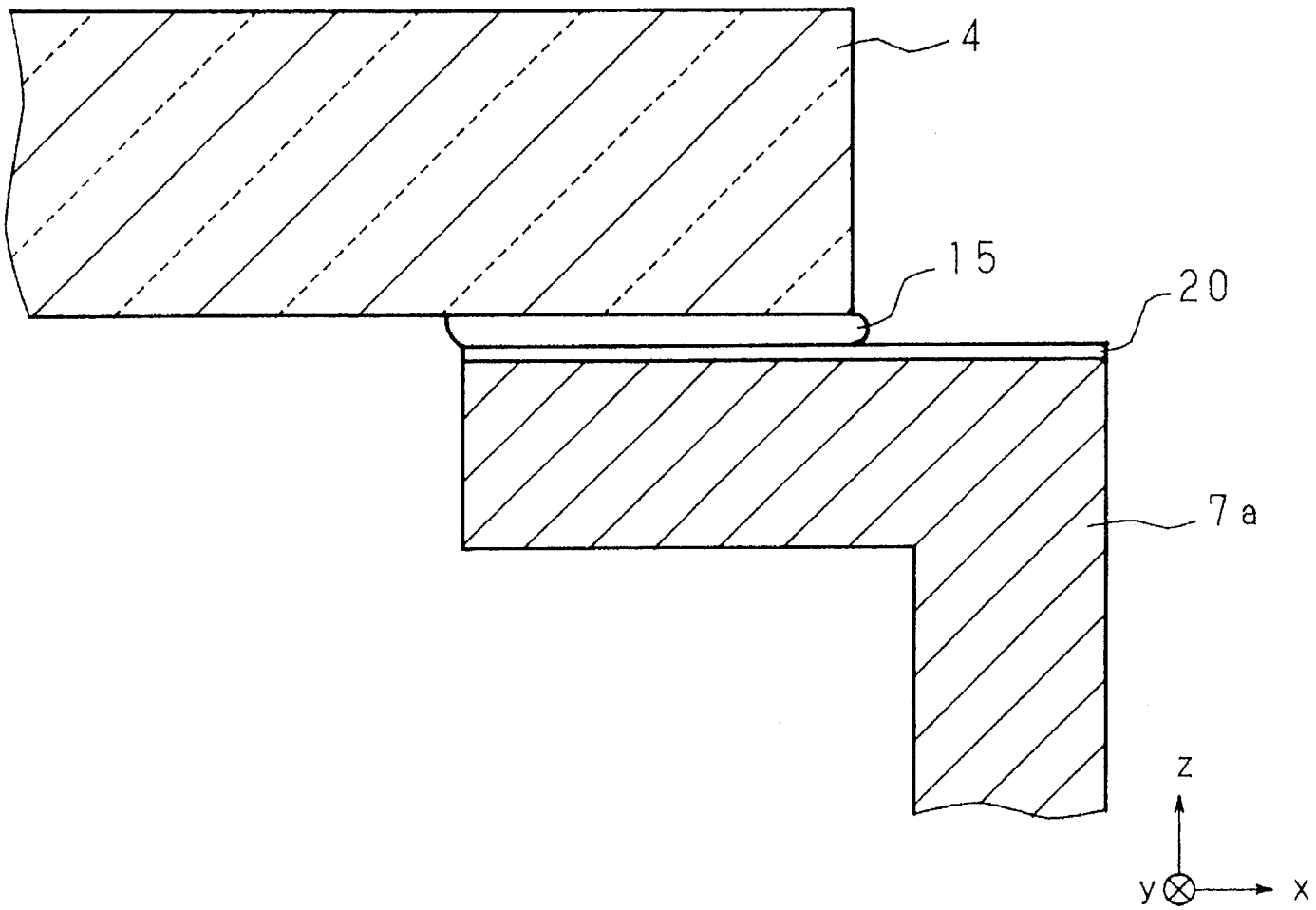
FIG. 3 PRIOR ART
FIG. 3 is a sectional view showing the front metal case formed with a Cr oxide film and then coupled with the screen glass through the frit glass.
Figure 4:
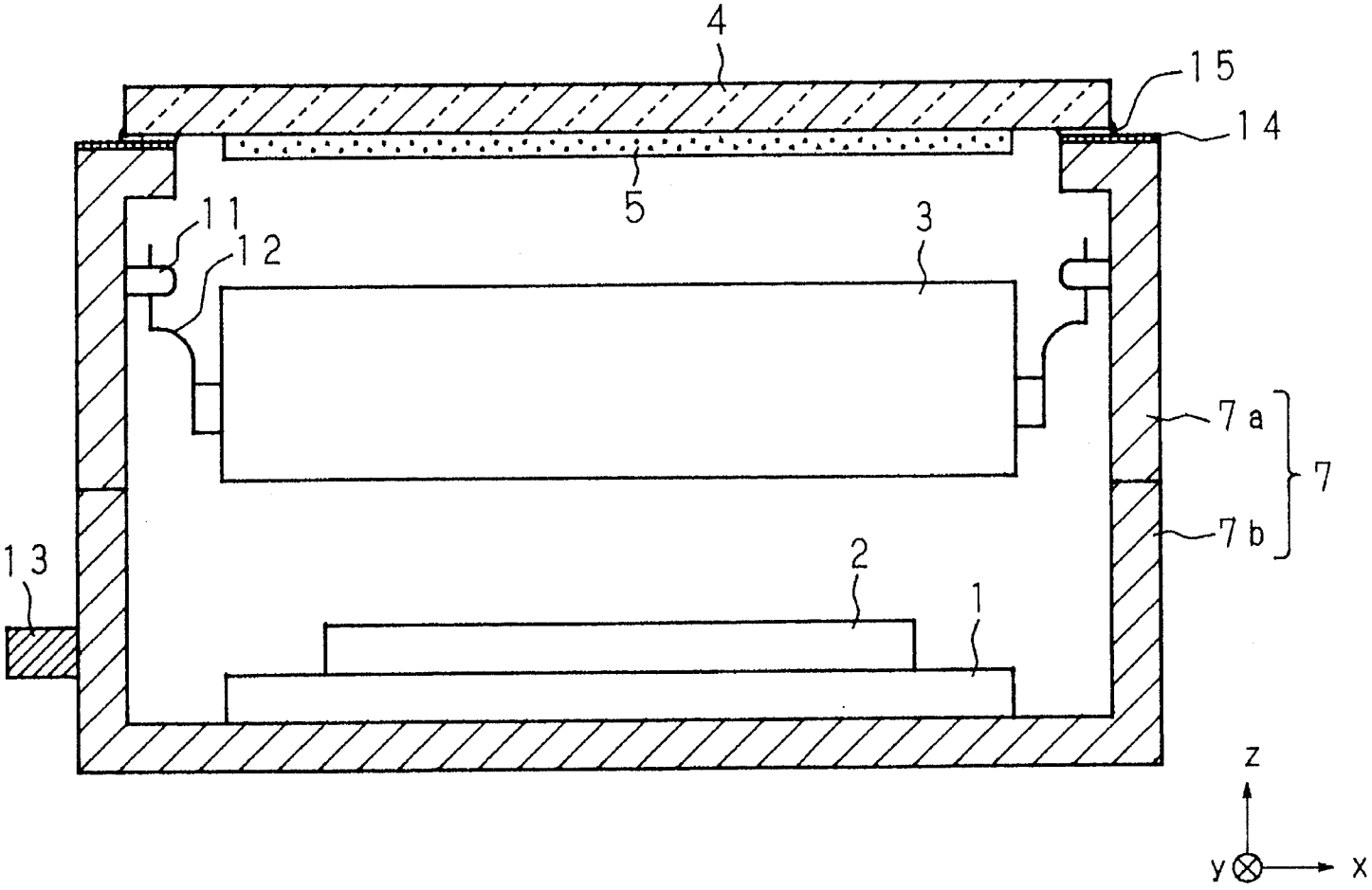
FIG. 4 is a schematic plan sectional view showing a flat cathode-ray tube according to the invention.

FIG. 4 is a schematic plan sectional view showing the configuration of a flat cathode-ray tube according to the invention. In FIG. 4, numeral 7 designates a flat housing-shaped metal case including a front metal case 7*a* and a rear metal case 7*b*. The front part of the front metal case 7*a* is open, and screen glass 4 of silicate family glass is hermetically sealed from the front side thereof through a ceramics film 14 and frit glass (crystallized frit glass) 15. Also, the metal case 7 has built therein an electron beam forming unit as a kind of electron gun including a cathode 1 providing an electron beam source, electron beam extraction means 2 for extracting the electron beam from the said cathode 1 and electron beam control means 3 for controlling the passage of the electron beams extracted by the electron beam extraction means 2 by a plurality of electrode plates.

The cathode 1 and the electron extraction means 2 are securely mounted in that order on the inside of the rear metal case 7*b*. Also, the electron beam control means 3 has springs 12, 12 mounted at the ends thereof, and is suspended with the springs 12, 12 detachably supported by ceramics stud pins 11, 11 erected from the inner side wall of the front metal case 7*a*.

The metal case 7 includes the front metal case 7*a* carrying the electron beam control means 3 coupled in opposed relation to the rear metal case 7*b* fixedly carrying the cathode 1 and the electron beam extraction means 2. Further, an exhaust pipe 13 for exhausting the interior of the metal case 7 to ultrahigh vacuum state ($10^{-5}$ Pa or less) is mounted on the rear metal case 7*b*.

The operation of the flat cathode-ray tube configured as above will be explained. The cathode 1 is set to a predetermined potential and the electron beam extraction means 2 is supplied with a predetermined voltage thereby to extract electron beams. With a control signal applied to the electron beam control means 3, the passage of the electron beams is controlled to cause the electron beams to impinge accurately on the said phosphor layer 5, thereby reproducing an image.

Figure 5:
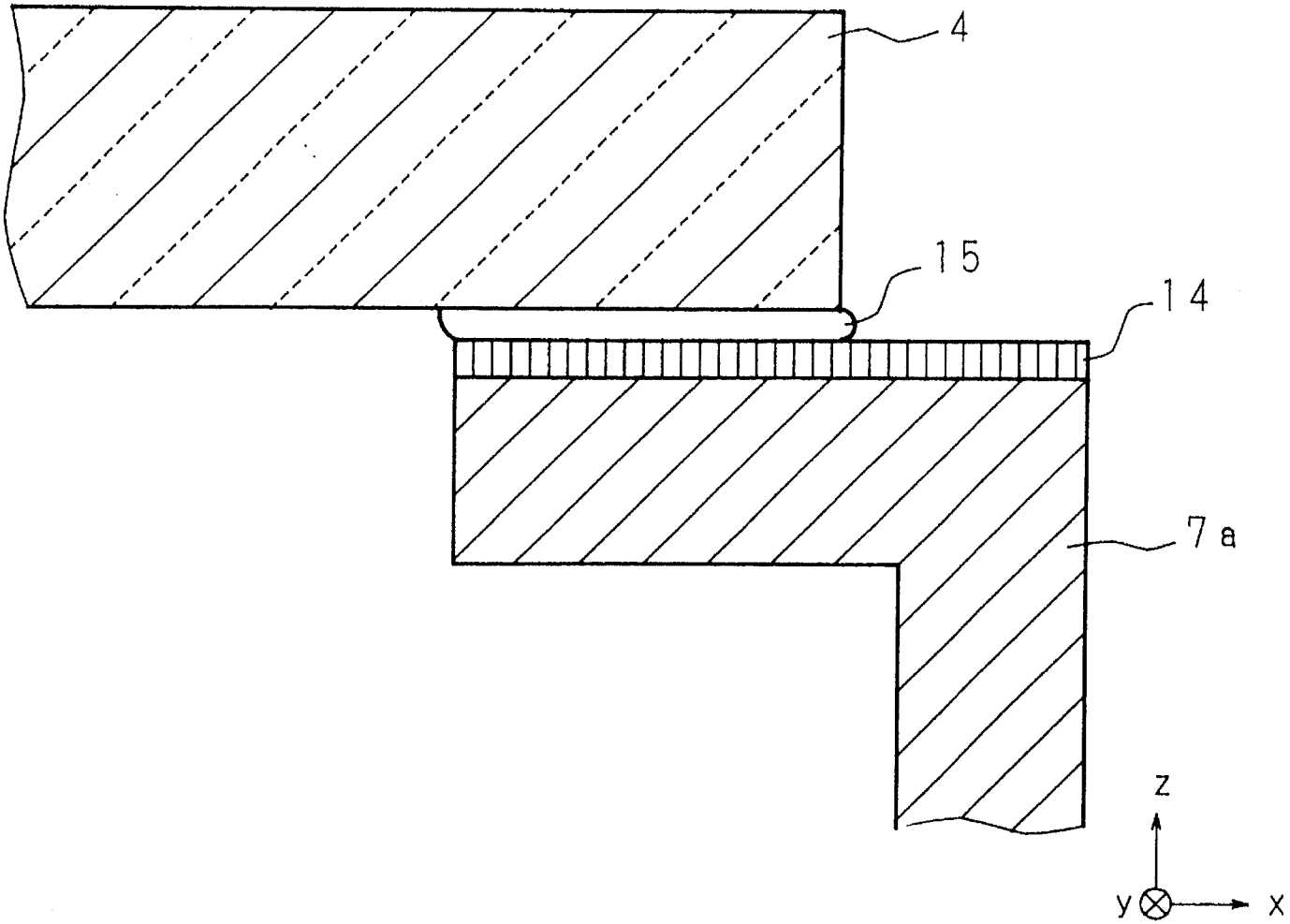
FIG. 5 is an enlarged sectional view showing the coupled portion between the front metal case and the screen glass.

FIG. 5 is an enlarged view showing the coupled portion between the front metal case 7*a* and the screen glass 4. The coupling procedure will be described below. First, the coupling surface of the front metal case 7*a* made of stainless steel (SUS430) processed to predetermined size and shape is toughened by sandblasting using $Al_2O_3$ abrasive grains, and further cleansed by degreasing. After that 8% $ZrO_2$—$Y_2O_3$ powder is thermally sprayed to the thickness of 30 to 50 μm to form a ceramics film 14 at the normal room temperature in the plasma thermal spray apparatus. After coating the frit glass 15 to a predetermined width and thickness, the screen glass 4 is placed thereon and baked at 440° C. for about 40 minutes, thus coupling the front metal case 7*a* and the screen glass 4.

Figure 6:
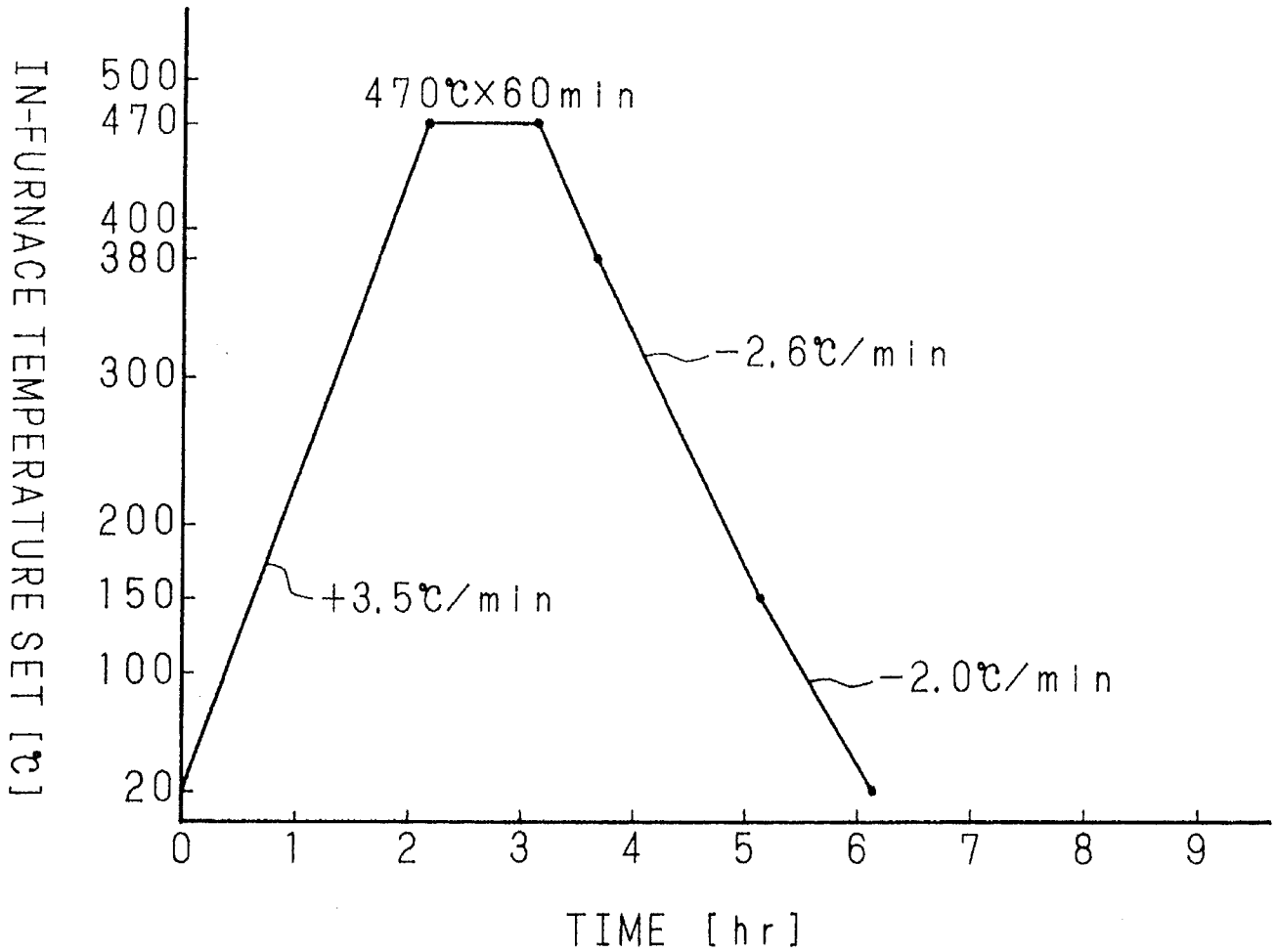
FIG. 6 is a graph showing an example of the in-furnace temperature set at the time of coupling with the frit glass.

FIG. 6 is a graph showing an example of the in-furnace temperature set at the time of coupling using the frit glass 15. As shown in FIG. 6, the temperature is increased at the rate of 3.5° C. per minute, and after holding at 470° C. for 60 minutes, decreased to 150° C. at the rate of 2.6° C. per minute, and then at the rate of 2.0° C. per minute. In the case where the in-furnace temperature is set to 470° C., the temperature of the coupling surface of about 440° C. was obtained.

Figure 7:
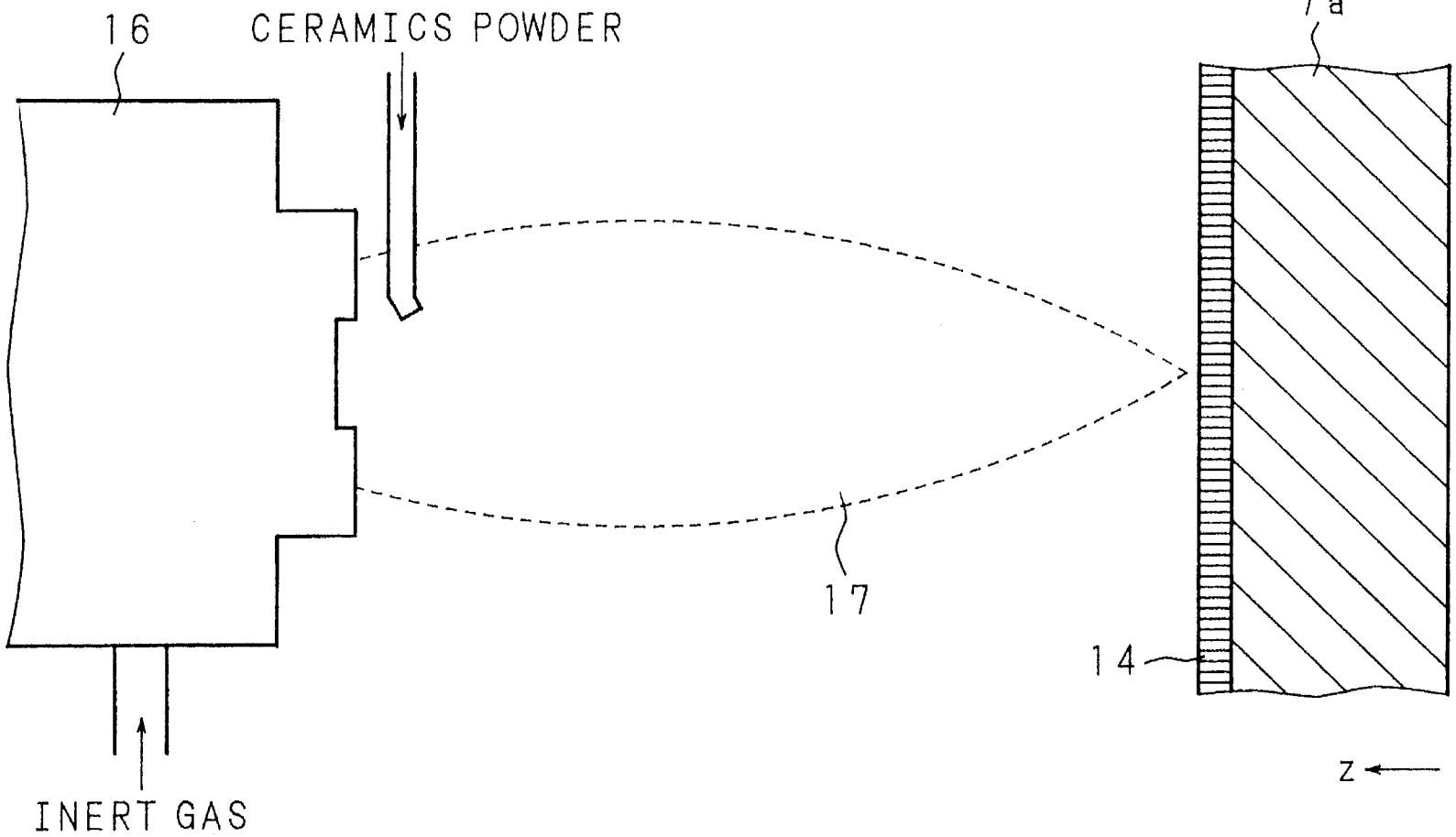
FIG. 7 is a schematic diagram showing the manner in which the plasma thermal spraying process is conducted in actual operation.

In the ceramics thermal spraying, the plasma thermal spraying process described above is in common practice. FIG. 7 is a schematic diagram showing the manner in which the plasma thermal spraying process is embodied. The plasma thermal spraying is the process in which $N_2$, $H_2$, or inert gases such as Ne, Ar is ionized by the plasma thermal spray gun 16, the ceramics powder of a material to be coated is fed into a high-temperature high-speed plasma jet issued from the plasma thermal spray gun 16, and the thermally sprayed particles 17 with fusion, injection and acceleration thereof in the jet are thus impinged on the front metal case 7*a* as the base material, thereby forming a film. The plasma jet is very high in temperature and is suitable for thermal spraying of a high-melting point material such as ceramics. The ceramics particles, after impinging on the base material, are rapidly solidified on being flatly deformed, and are successively accumulated to form a film.

In spite of the fact that the thermal spraying is the process for fusion-depositing a high-melting point material, the temperature increase of the base material is generally known to be comparatively small and to be controlled to about 150° C. Consequently, the likelihood of the base material being deformed by the impingement with the thermally sprayed particles 17 is considered small. In this embodiment, the temperature increase of the front metal case 7*a* is about 100° C. without any metal deformation and the like. Also, the ceramics film 14 thermally sprayed can be processed to a high dimensional accuracy and a superior surface roughness by grinding.

Figure 8:
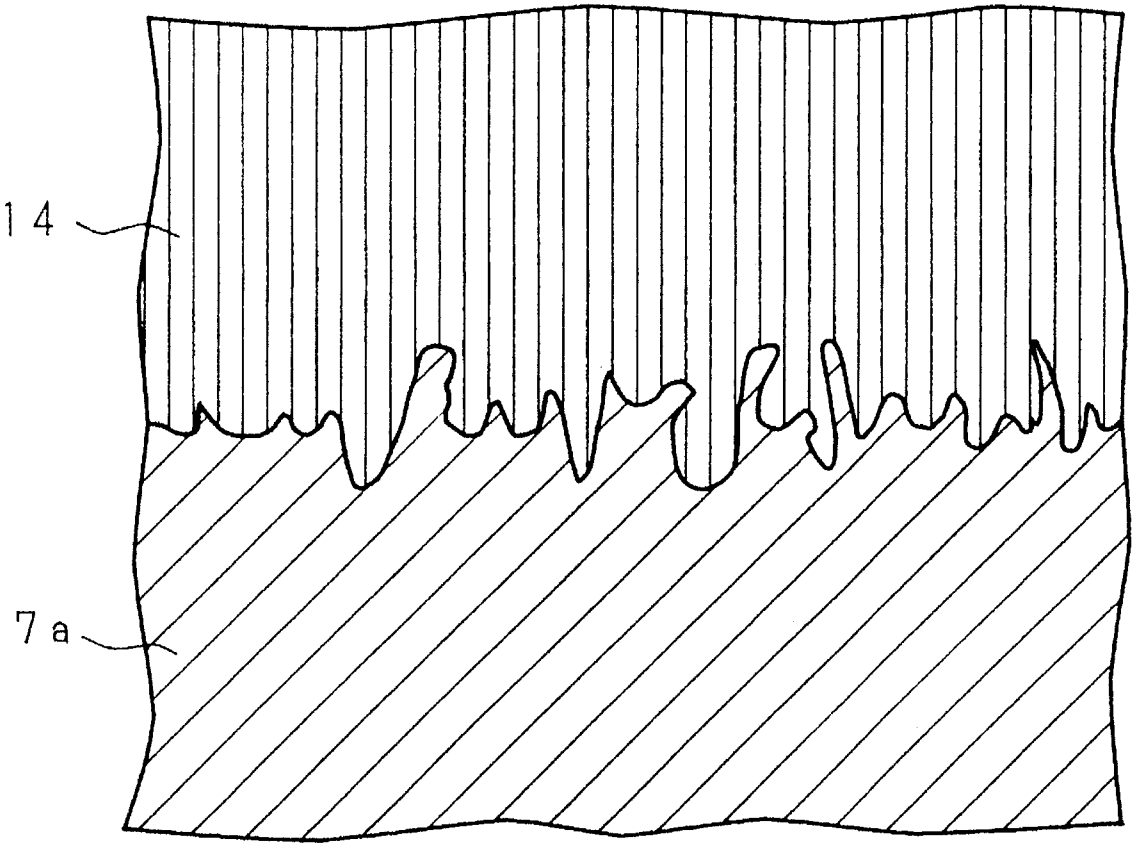
FIG. 8 is a sectional view showing the coupled portion in enlarged form between the ceramics film and the front metal case.

FIG. 8 is an enlarged sectional view showing the coupled portion between the ceramics film 14 and the front metal case 7*a* as the base material. This coupling is considered primarily due to the anchoring effect as shown in FIG. 8. A multiplicity of pores generated at the time of thermal spraying and existing in the ceramics film 14 has the ability to absorb and alleviate the difference in linear expansion coefficient between the material thermally sprayed and the base material.

The measurement of the coupling strength of the ceramics film 14 formed by the plasma thermal spraying against the frit glass 15, as compared with other samples, is shown in the table below. The measurement used as samples the stainless steel (SUS430) of 30 mm×30 mm×5 mm thick, the surface of which is subjected to the plasma thermal spraying thereby to form a ceramics film 14 to the thickness of 60 μm, the stainless steel the surface of which is subjected to the wet hydrogen oxidation to form a Cr oxide film 3 μm thick, and a glass plate (#5000). Each sample was heat-treated at 40° C. for an hour to cause natural fusion of frit glass. After thus attaining the diameter of about 25 mm, the coupling strength between the sample plate and the frit glass was measured by the tensile strength test. The data is given as an average value obtained as a result of five tests.

| Sample | Breaking strength | Relative strength |
|---|---|---|
| Stainless steel + ceramics film | 61 kg/cm$^2$ | 117% |
| Stainless steel + Cr oxide film | 54 kg/cm$^2$ | 104% |
| Glass plate | 52 kg/cm$^2$ | 100% |

The table shows that the coupling strength of the ceramics film 14 against the frit glass is higher than that of the glass or the Cr oxide film which has a proven performance in many fields concerning the coupling with the frit glass. Further, although the metal composition of the metal case in forming a Cr oxide film applied in the prior art is limited to Fe—Cr family, and the like, there is no such a limitation imposed in forming the ceramics film 14 according to the invention.

After a rear metal case 7*b* is welded by metal to a front metal case 7*a* with screen glass 4 coupled thereto, vacuum is attained from an exhaust pipe 13 through the heat treatment process at 400° C. for 20 minutes (temperature increased at the rate of 10° C. and decreased at the rate of 10° C. per minute). In the process, no abnormality was observed at the coupling portion between the glass and the metal. Also, after an external atmospheric pressure is applied to the flat cathode-ray tube and the pressure difference of 3 kg is held between the internal and external atmospheres for ten minutes, the case was not damaged nor did the glass/metal coupling exhibit any abnormality. The airtightness check conducted with a He leak detector after the test shows that there is no leak detected that exceeds the apparatus limit.

[Embodiment 2]

Figure 9:
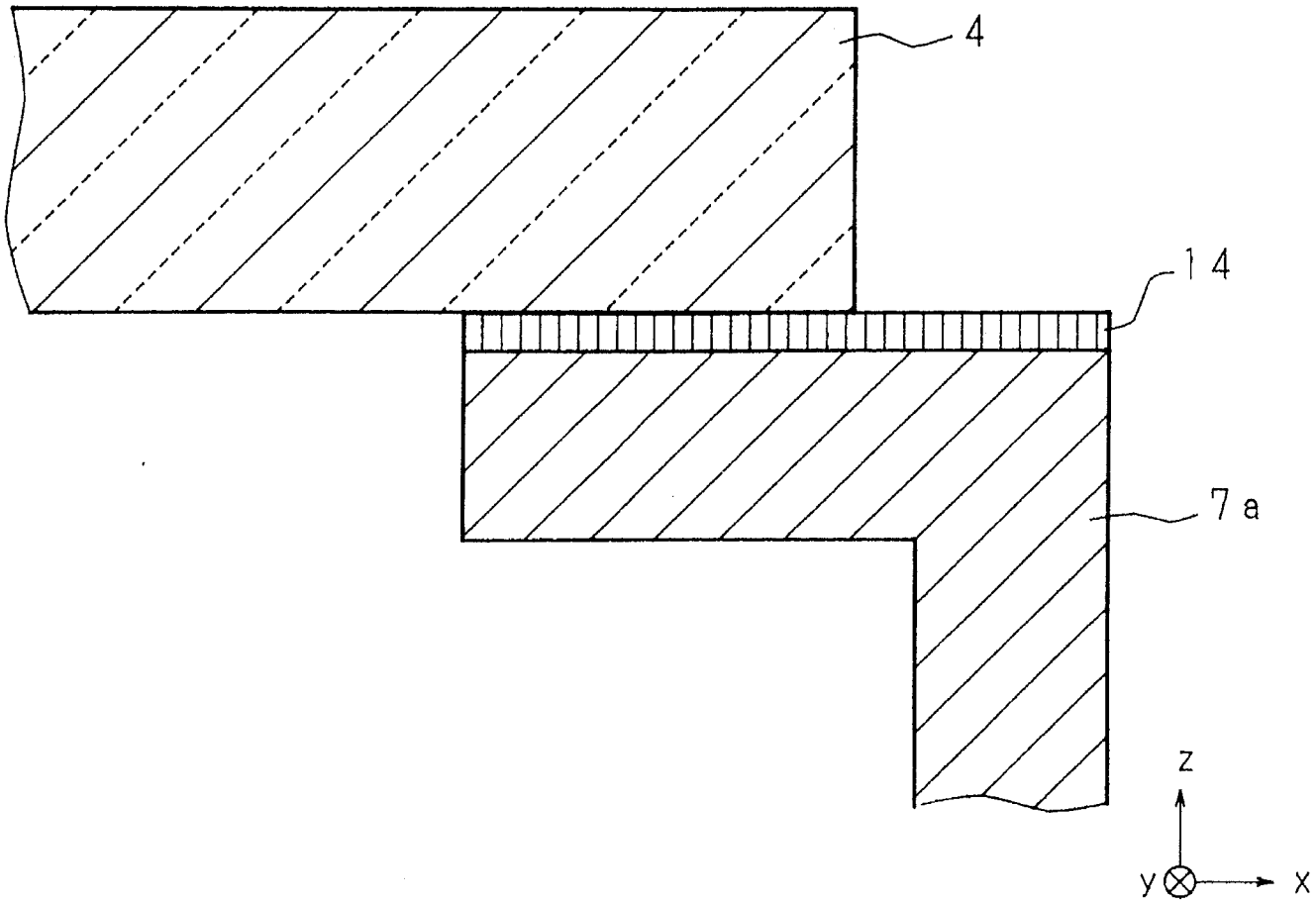
FIG. 9 is a schematic sectional view showing the coupled portion of a flat cathode-ray tube according to another embodiment of the invention.

FIG. 9 is a schematic sectional view showing the coupled portion between the front metal case 7*a* and the screen glass 4 of the flat cathode-ray tube according to another embodiment of the invention. According to this embodiment, the front metal case 7*a* forming the ceramics film 14 and the screen glass 4 are coupled by glass fusion to each other. The remaining component parts are similar to those of FIG. 4. The glass fusion is conducted by heating at 900° C. for 30 minutes and gradually cooling in an $N_2$ environment furnace using a carbon die for suppressing the setting deformation and positioning the screen glass 4 relative to the front metal case 7*a*.

Figure 10:
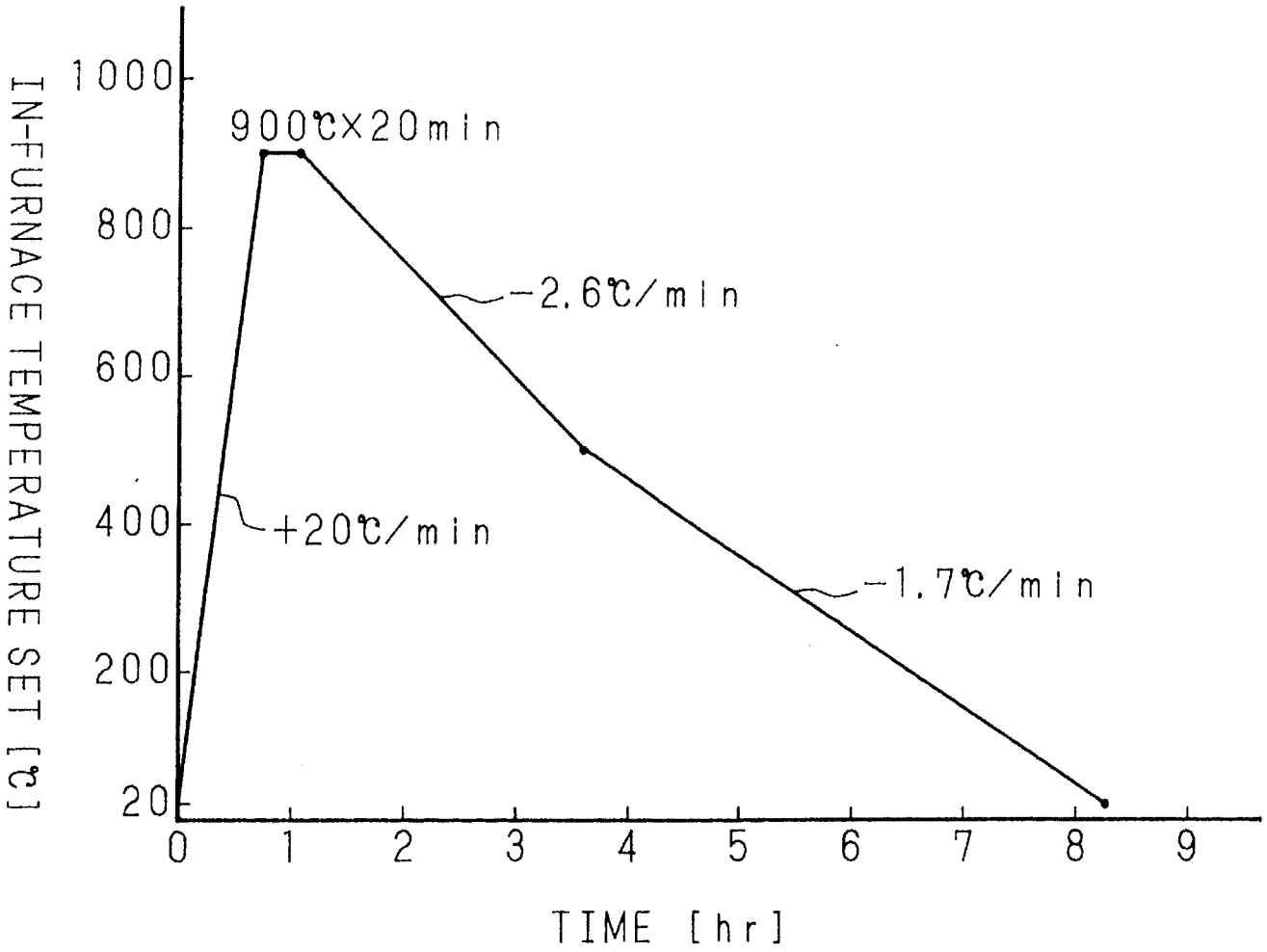
FIG. 10 is a graph showing an example of the in-furnace temperature set at the time of glass fusion coupling.

FIG. 10 is a graph showing an example of the in-furnace temperature set at the time of glass fusion. As shown in FIG. 10, the temperature is increased at the rate of 20° C. per minute and maintained at 900° C. for 20 minutes, after which it is decreased to 550° C. at the rate of 2.6° C. per minute and subsequently at the rate of 1.7° C. per minute. In this embodiment, as in the above-mentioned embodiments, a satisfactory coupling is obtained.

[Embodiment 3]

Figure 11:
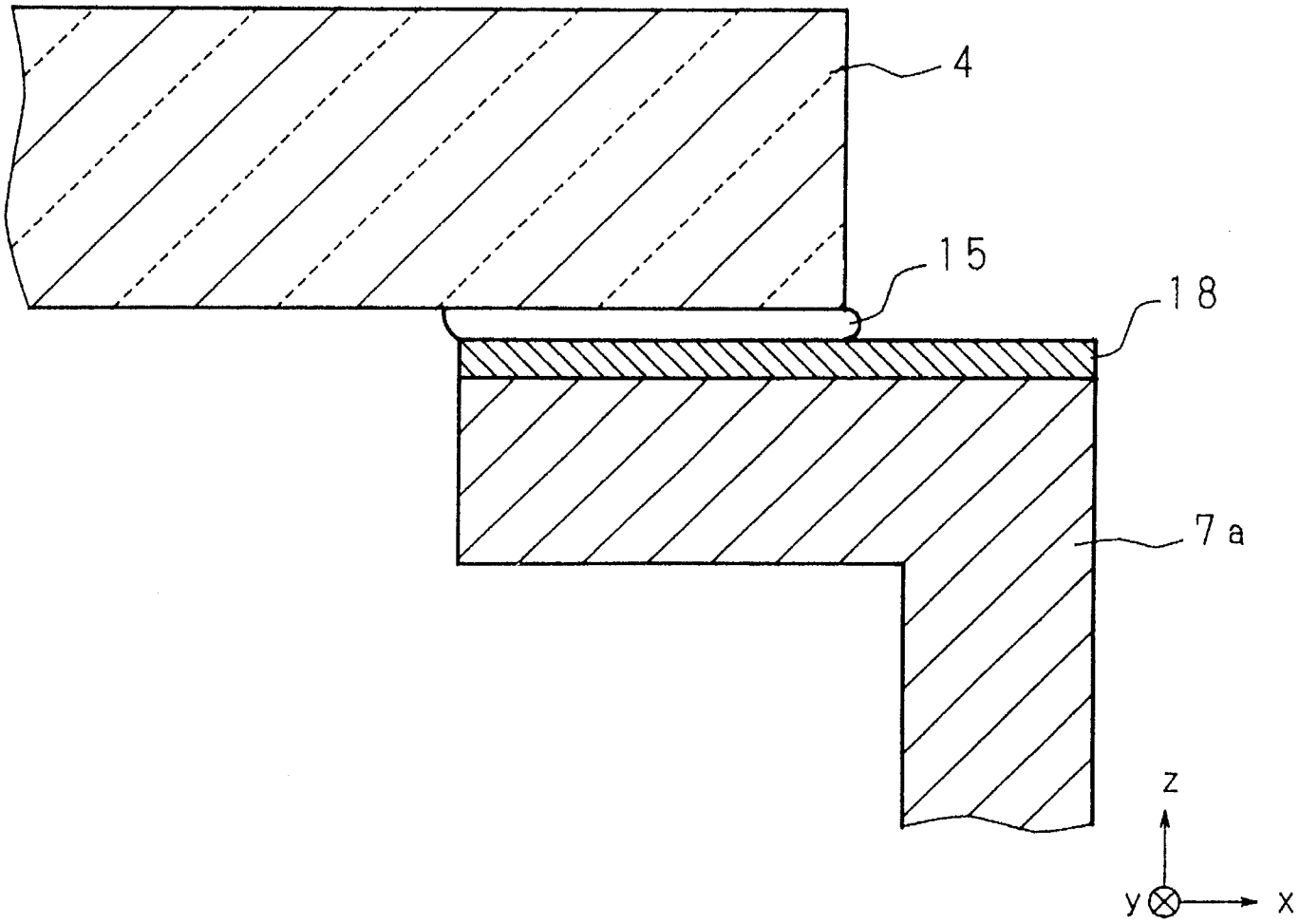
FIG. 11 is a schematic sectional view showing the coupled portion of a flat cathode-ray tube according to still another embodiment of the invention.

FIG. 11 is a schematic sectional view showing the coupled portion between the front metal case 7*a* and the screen glass 4 of a flat cathode-ray tube according to another embodiment of the invention. According to this embodiment, a glass film 18 is formed on the surface of the front metal case 7*a*, and further frit glass 15 is formed to couple the front metal case 7*a* and the screen glass 4. The remaining configuration is similar to that of FIG. 4. In the above-mentioned embodiments a ceramics film 14 is formed by feeding ceramics powder to plasma jet issued from the plasma thermal spray apparatus. According to the invention, glass powder instead of ceramics powder is fed to plasma jet to form a glass film 18 in the thickness of 30 to 50 μm. The $SiO_2$—PbO family glass having a linear expansion coefficient of $100\times10^{-7}$/° C. substantially identical to that of the screen glass 4 and a softening point of 660° C. is used as the glass powder.

As in the aforementioned embodiments, the strength and airtightness of the inventional apparatus after rear metal case 7*b* being welded by metal were tested in vacuum condition, no abnormality was detected for the parts including the glass/metal coupling. The front metal case 7*a* was used after preheating to 400° C. in order to improve the adhesiveness of the glass film 18, without any deformation observed of the front metal case 7*a*.

[Embodiment 4]

Figure 12:
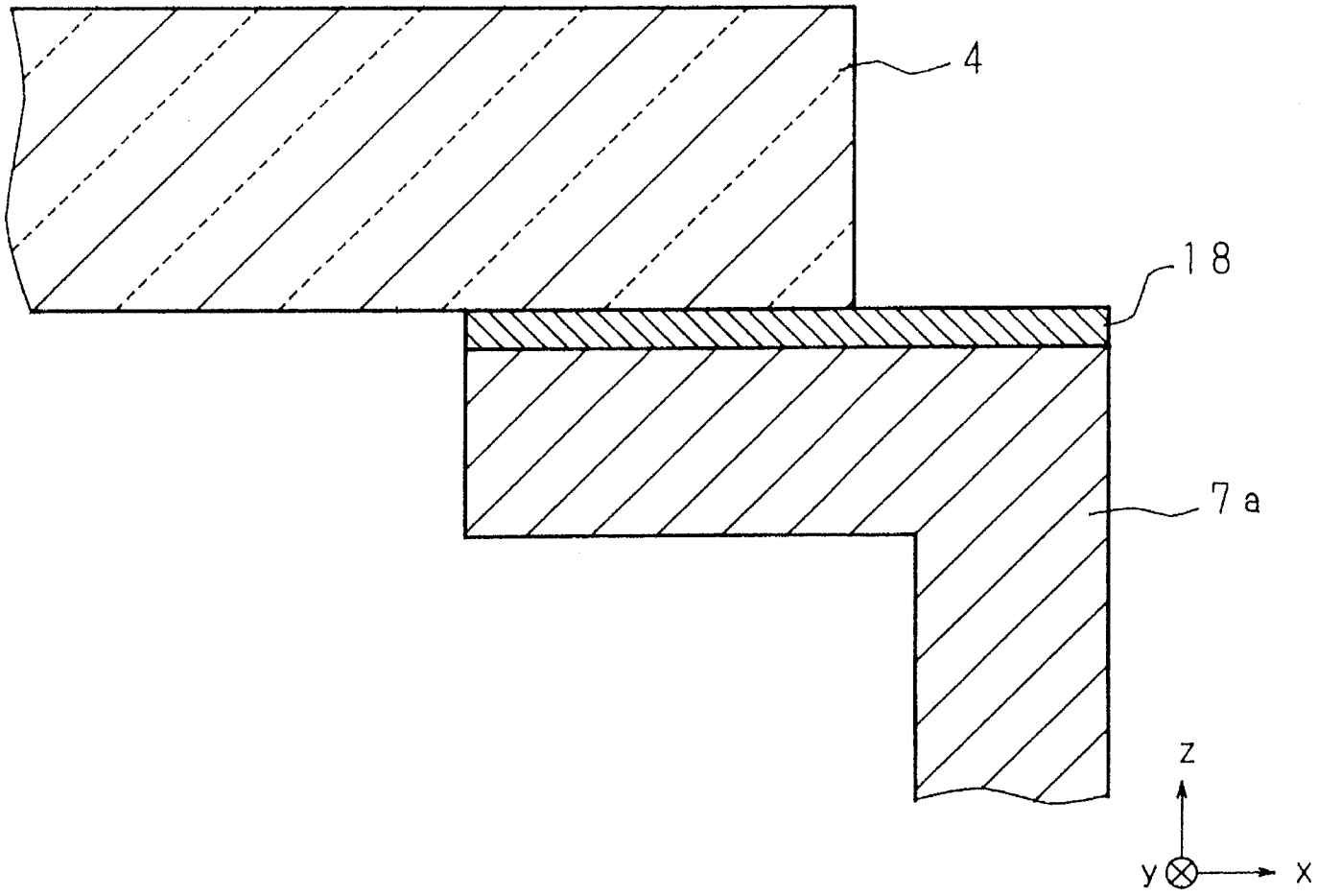
FIG. 12 is a schematic sectional view showing the coupled portion of a flat cathode-ray tube according to a further embodiment of the invention.

A satisfactory effect was obtained as in the aforementioned embodiments when the glass film 18 and the screen glass 4 were coupled by glass fusion as shown in FIG. 12.

In the flat cathode-ray tube according to the invention, a sufficient strength, airtightness and dimensional accuracy can be secured with a metal case that can be reduced in weight regardless of the shape and size thereof. As a result, the invention is applicable also to a flat cathode-ray tube such as the High-Vision picture tube requiring a high general assembly accuracy. Further, unlike in the conventional wet hydrogen process, a number of parts can be processed simultaneously and continuously, thereby contributing to a superior mass-productivity.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A flat cathode-ray tube comprising:

a metal case having a front opening and for housing an electron beam forming unit;

a glass screen which seals said front opening; and a ceramics film formed by thermally spraying an oxide family ceramics on a surface of said metal case and interposed between said metal case and said glass screen, wherein some of said ceramics film is inserted in said metal case below said surface of said metal case on which said ceramics film is formed.

2. A flat cathode-ray tube according to claim 1, wherein said ceramics film is formed by thermally spraying $ZrO_2$—$Y_2O_3$.

3. A flat cathode-ray tube according to claim 1, wherein crystallized frit glass is interposed between said ceramics film and said glass screen.

4. A flat cathode-ray tube according to claim 1, wherein said ceramics film and said glass screen are coupled by glass fusion.

5. A flat cathode-ray tube comprising:

a metal case having a front opening and for housing an electron beam forming unit;

a screen glass which seals said front opening; and a glass film formed by thermally spraying an inorganic oxide family glass having a linear expansion coefficient substantially equal to that of said glass screen on said metal case and interposed between said metal case and said glass screen.

6. A flat cathode-ray tube according to claim 5, wherein said glass film is formed by thermally spraying $SiO_2$—PbO family glass.

7. A flat cathode-ray tube according to claim 5, wherein a crystallized frit glass is interposed between said glass film and said glass screen.

8. A flat cathode-ray tube according to claim 5, wherein said glass film and said glass screen are coupled by glass fusion.

* * * * *

UNITED STATES PATENT AND TRADEMARK OFFICE

CERTIFICATE OF CORRECTION

PATENT NO. : 5,528,100

DATED : June 18, 1996

INVENTOR(S) : Shunichi IGETA, et al.

It is certified that error appears in the above-indentified patent and that said Letters Patent is hereby corrected as shown below: On the title page:

Please change "(73) Assignee: Mitsubishi Denki Kabushiki Kaisha
Tokyo, Japan"

to

--(73) Assignees: Mitsubishi Denki Kabushiki Kaisha;

Asahi Glass Company Ltd.,
both of Tokyo, Japan

Signed and Sealed this

First Day of April, 1997

Bruce Lehman

*Attest:*

BRUCE LEHMAN

*Attesting Officer*

*Commissioner of Patents and Trademarks*